US007156092B2

(12) United States Patent
Otter

(10) Patent No.: US 7,156,092 B2
(45) Date of Patent: Jan. 2, 2007

(54) EMERGENCY AIR SUPPLY WORN AS NORMAL APPAREL

(76) Inventor: Russell Wolfe Otter, P.O. Box 340, Blue Jay, CA (US) 92317

( * ) Notice: Subject to any disclaimer, the term of this patent is extended or adjusted under 35 U.S.C. 154(b) by 79 days.

(21) Appl. No.: 10/373,323

(22) Filed: Feb. 24, 2003

(65) Prior Publication Data

US 2004/0099262 A1 May 27, 2004

Related U.S. Application Data

(60) Provisional application No. 60/428,974, filed on Nov. 25, 2002.

(51) Int. Cl.
*A62B 18/02* (2006.01)

(52) U.S. Cl. ..... 128/201.18; 128/201.27; 128/205.15; 128/205.22

(58) Field of Classification Search ..... 128/200.24, 128/200.25, 201.27, 201.28, 205.15, 205.22
See application file for complete search history.

(56) References Cited

U.S. PATENT DOCUMENTS

| | | | | | |
|---|---|---|---|---|---|
| 3,491,752 | A | | 1/1970 | Cowley | |
| 4,253,454 | A | | 3/1981 | Warncke | |
| 4,964,405 | A | | 10/1990 | Arnoth | |
| 4,972,684 | A | * | 11/1990 | Aitken | 63/8 |
| 5,127,399 | A | | 7/1992 | Scholley | |
| 5,217,143 | A | * | 6/1993 | Aitken | 222/78 |
| 5,358,144 | A | * | 10/1994 | Mock | 222/78 |
| 5,517,984 | A | | 5/1996 | Sanders | |
| 5,529,061 | A | | 6/1996 | Sanders | |
| 5,855,307 | A | * | 1/1999 | Biddick et al. | 224/267 |
| 5,868,130 | A | * | 2/1999 | Stier | 128/201.28 |
| 5,877,742 | A | * | 3/1999 | Klink | 345/685 |
| 6,200,243 | B1 | * | 3/2001 | Meranto | 482/105 |
| 6,223,744 | B1 | * | 5/2001 | Garon | 128/200.14 |
| 6,526,968 | B1 | * | 3/2003 | Izuchukwu et al. | 128/202.19 |

* cited by examiner

*Primary Examiner*—Michael J. Hayes
*Assistant Examiner*—Michael G. Mendoza
(74) *Attorney, Agent, or Firm*—The Walker Law Firm; Allan H. Grant

(57) ABSTRACT

Provides an emergency air supply system that is worn around the arm, presumably the wrist, and intended for use in air restrictive emergency conditions. Primarily it has been designed for the need to improve safety for water recreation or water sports where an individual is often caught gasping for air. This device is purposely designed to be no more obtrusive than a piece of clothing, such as a bathing suit, or a watch band would be, in order that it does not unduly restrict the water activity or water sport or any other potentially air restrictive activity you may engage in. The design is intended to encourage usage and increase safety, by way of its structural design that uses the strap-band itself as the mechanical structure of the entire mechanism. Thus creating a unique compact design, that is convenient to wear and provides air when you most need it.

24 Claims, 8 Drawing Sheets

EMERGENCY AIR SUPPLY WORN AS NORMAL APPAREL

CROSS-REFERENCE TO RELATED APPLICATIONS

The present application claims priority under 35 U.S.C. 119(e) and under applicable U.S. statutes and regulations, to U.S. Provisional Application Ser. No. 60/428,974, filed Nov. 25, 2002. The disclosure of which is incorporated herein by reference in its entirety.

FIELD OF THE INVENTION

The present invention relates to an Emergency Air Device and, more particularly, to a portable and wearable emergency air system for providing an easily wearable device, that as well maybe detachable and held and operated in the mouth in and of itself. The new invention is designed to be no more obtrusive than a piece of clothing or a bathing suit might be, but with the added function of providing immediate oxygen/air availability. It could be worn on the arm, preferably the forearm and most probably the wrist. For the purpose of explanation in this patent I will concentrate my diagrams and explanation, using a Velcro wrist-band device, but any attachable strap device would work, be it snaps, hooks, and so on . . . The device could also be attached temporarily or permanently to any clothing or wearable equipment, such as the sleeve of a wet suit or even attached inside a watch-band.

Examples of usage: Any individual involved in a water recreation or water sport, such as body, wind or board surfing, sailing, rafting, kayaking, etc.; along with any such activity that may cause temporary air restriction or respiratory exhaustion. With these aforementioned conditions an individual who is body surfing in the ocean, for example, and who has lost control under the water in wave turbulence and is in need of air, could use the device, by either moving the arm to the mouth or quickly detaching the device and holding it the mouth, thus freeing up both arms to continue swimming to the surface for permanent air relief, thus avoiding a potential drowning and saving a life.

BACKGROUND OF THE INVENTION

Emergency portable air devices have been in use for years. Typically, emergency portable air devices are comprised of a conventional, generally large manually hand-operated oxygen tank or tanks strapped to the body, (waist, or back), as in patent numbers: 2002/0153009 A1, U.S. Pat. Nos. 5,529,061, 3,491,752, 2002/0148467 A1, U.S. Pat. No. 5,517,984. Some emergency air systems maybe hand-held as well. All of these systems are either 1) Umbilically connected to the mouth via a hose and mouth piece device, or 2) are hand-held, or attached to other apparel. Consequently they are large and cumbersome, and not conducive to being worn without drawing clear and sometimes unwanted attention, unlike this proposed new invention, which is designed to be non-descript and worn as normal apparel, no less than a wrist watch would be.

These large body worn and umbilically mouth piece connected or hand-held devices do sometimes restrict water recreation and water sport activities. They would even be considered dangerous in certain adverse wave turbulence or rocky sea shore bottom conditions or in a river running a kayak near the rocks, or where you need all of your physical mobility, which the prior art devices could in some instances constrain and restrict physical mobility and even further endanger. Therefore they do not provide to a large community of water sport and recreation users the type of air safety devices they could use and are in need of today.

This new device provides for virtually complete physical mobility, unlike other devices, given the structural circumstances of the prior art presented in the previous paragraph. Further this new device is both usable in an attached arm mode held up to the mouth, or is also usable in a detached mode, held only by the mouth, whereby the air regulating system is designed to be controlled with the mouth and the teeth only, if desired.

This new emergency air device addresses the problem for everyone who has ever been caught gasping for air in an underwater or similar air restrictive situation. Most of us have experienced the discomfort and fear when caught under a river current or an oceans wave turbulence, or for that matter caught under the water in a swimming pool for any variety of reasons. This new device provides for the security of mind and critical safety, when engaged in a water activity or any activity that might create a condition whereby your air supply is restricted and you need immediate oxygen relief.

Primarily other prior art emergency air supply devices present themselves both structurally and operationally as to restricting, in size, or method of operation. In some cases other systems could also be unsafe, if surfing or kayaking near rocks that could snare and snag larger profile equipment causing a variety of safety concerns. This new device is designed to ameliorate or eliminate those consequences, and provide the user with a simple apparatus that does not unduly restrict activity, and therefore is easy and safe to use.

The only other device in prior art that I found through a formal patent search was a device that is similar in how it is applied to the mouth for medical purposes (Medication Dispenser) for nicotine or asthmatics, etc.—which is patent "U.S. Pat. No. 6,233,744 B1". This prior art device is fundamentally distinct from the device I am seeking a patent for—in Structure, Methodology of Use and Functional Purpose. It is similar in that is does not use an umbilical connection, nor is it hand held, and it uses the wrist to attach too.

It is dissimilar in the following:

1. Structurally patent "U.S. Pat. No. 6,233,744 B1" only uses a STRAP to attach to the wrist and to the mechanical apparatus that supplies the aerosol Medication. In contrast—this new device structurally uses the STRAP as the mechanical structure in and of itself, as it houses the air and mechanical mouth regulator, as it wraps around the arm. To have only used the STRAP as an attachment mechanism in this new invention would have made the claims regarding "Non-Descript", "Non-Obtrusive" and "Not Unduly Restrictive " to the activity you were engaged in—invalid. This particular prior art device is contrary to those concepts.
2. The Prior Art embodied in patent "U.S. Pat. No. 6,233,744 B1" also could not contain adequate liters of air necessary, as its compartments would be to small, without creating a large—very descript and bulbous mechanism on top of the wrist to manage the air volumes necessary, which is contrary to the safety and design intent embodied in this new invention. The structural design of all prior art in this field does not meet the low profile design and safety elements fashioned into this new design.

Consequently the Structural aspects are distinct opposites, i.e. one attaches the Arm and Aerosol Device to a Strap, and the Other Device is designed within the Strap, which provides additional operational distinctions as well.

3. The Prior Art in patent "U.S. Pat. No. 6,233,744 B1" also does not function as an Air Supply Device; it only functions as a Medical Aerosol device. In all 17 of its claims it only refers to being used for "Aerosols". This new patent is not an Aerosol Device, as "Aerosols", use a propellant (usually an inert gas) and an active ingredient, liquid or particle (medication). This new invention is not an "Aerosol" at all by definition, as it only holds pressurized Air. Nor does this new device make any claims on being used as a medical supply aerosol dispenser. However structurally it would appear to be prima facie distinct, and I would surmise it therefore could be used in such a manner, given that a medical patient may want to have a more private less descript means of dispensing a medication in an emergency situation, in lieu of a more visual and obvious device, as represented in patent "U.S. Pat. No. 6,223,744 B1". That case, for medical purposes and converting this new device to an aerosol device being made, I am not seeking a patent for those purposes. Essential to the field of water sports and water recreation is the need for an emergency air device that can provide the attributes previously defined for a safe, ease of use device, thus encourage usage, to enhance both peace of mind and critical safety. The patent "U.S. Pat. No. 6,233,744 B1" or any other prior art previously discovered does not meet, nor could they meet those criteria, structurally or functionally.
4. Patent "U.S. Pat. No. 6,223,744 B1" is also exclusively an electro-mechanical device, using microprocessors, circuit boards, and a battery power supply. This again, is in structural and operational contrast, to the new device in that the new device is not designed to operate as an electro-mechanical device. The new device is designed to operate mechanically without any power source, other than an individual's physical interactions, and thereby eliminates the critical points of failure endemic with electronic devices in a water based environment.

Summarizing the shortcomings of the Prior Art is as follows:

1. Large and cumbersome to wear and use. Thus does not encourage usage, reducing safety and additional loss of life.
2. In some situations, the previously large emergency equipment could snag on rocks or other impediments destroy the equipment and increase the safety risks.
3. Impedes and restricts activities, as the equipment is too large or cumbersome. (Usually either Hand-Held or Umbilically connected from tank to mouth.)
4. Other emergency air devices are not worn as normal everyday apparel, such as a watch-band, as this new apparatus would be, and therefore the prior art can draw unintended or undue attention.
5. Limited effectiveness in promoting and encouraging usage, through type of design and method of use.
6. In some cases, such as with patent "U.S. Pat. No. 6,233,744 B1", it is not used for, nor intended for use as an Air Supply device, and if it were, the design would not allow for enough air capacity, unless designed in a much larger more bulbous and more cumbersome manner, which would be problematic for safety and ease of use, and causing undue obstruction to movement in the water, along with safety concerns due to its bulbous wrist-top attachment design.
7. Not all emergency air systems or similar prior art are for use in a water based environment.
8. Prior Art to date does not encourage universal usage, which is a design objective of this new device.

It is therefore an object of the invention to promote safety, by encouraging emergency air device usage in all activity aspects that may cause air restriction.

It is another object of the invention to provide a tool that can reduce the level fear and anxiety both in the Emergency Air Device users mind and in the minds of parents and others who may be responsible for a child's or individuals welfare when simply swimming in a pool with friends or engaged in any activity that may create an restricted air environment.

It is another object of the invention to provide an Emergency Air System, which is desired by many, but yet unavailable in the market place.

It is another object of the invention to save lives, by providing air in a simple and seemingly natural, almost automatic manner, when you most need it.

SUMMARY OF THE INVENTION

In view of the foregoing disadvantages inherent in the known types of "Emergency Air Supply Devices" now present in the prior art, the present invention provides a new wearable emergency air system construction that is neither an umbilically connected mouth piece nor hand-held emergency air system. In operation this device is simply worn around the arm presumably the wrist and is intended for use in air restrictive conditions. Once the device is held up to the mouth it is activated in the present design with the teeth squeezing the tubular, mushroom topped mouth piece which then regulates the air flow into the mouth.

Primarily it has been designed for the need to improve safety for water recreation or water sports were an individual is often caught gasping for air. This "Emergency Air Supply Device" provides the fix for that situation, were other such devices have not succeeded. Primarily because other devices are not conducive to use in highly physically demanding activities, such as wind, board, or body surfing, kayaking, sailing or rafting, or for that matter simply playing in the swimming pool, were for any variety of reasons your air becomes restricted. Fundamentally other "emergency air systems" structurally and operationally present themselves as to restricting, in size, or method of operation for use in very common or routine water recreation, water sport or other air restrictive routine activities. In some cases other systems could also be unsafe, if surfing or kayaking near rocks, that could snare and snag larger profile equipment causing a variety of safety concerns. This new device is designed to substantially reduce or eliminate those consequences, and provide the user with a simple apparatus, which does not unduly restrict your engaged in activity, and therefore is easy and safe to use. It provides air when you most need it. It is mechanically self-contained, worn on the arm presumably the wrist as any watch band would be worn. The design is intended to be wearable virtually at all times without looking out of place, i.e. worn as normal apparel. Given the devices intended ease of use—it should therefore encourage usage, and improve safety, saving lives and providing additional peace of mind to those responsible for individuals, or the individuals themselves, engaged in potentially air restrictive activities.

The working name for this new device is an acronym: "NOAH" which embodies several of its novel and unique characteristics:

Non Umbilically connected or Hand-Held

Oxygen—Air Supply used both in or out of water
Armband attached or detachable Mouth-Held
Housing specifically designed to not unduly restrict activity

BRIEF DESCRIPTION OF THE DRAWINGS

A complete understanding of the present invention may be obtained by reference to the accompanying drawings, when considered in conjunction with the subsequent, detailed description, in which.

For purposes of clarity and brevity, like elements and components will bear the same designations and numbering throughout the FIGURES.

DESCRIPTION OF THE PREFERRED EMBODIMENT

Figure 1:
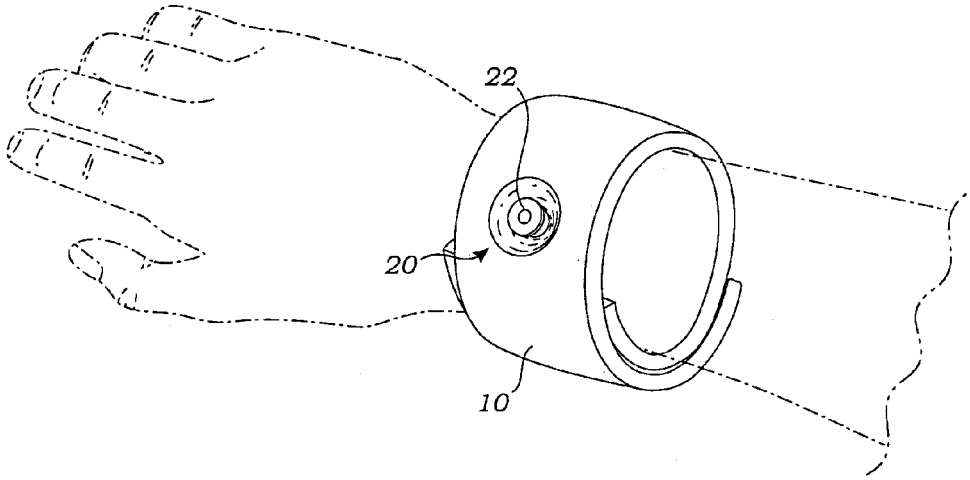
FIG. 1 This illustrates the Emergency Air Device as it would appear attached to the wrist, with the mouth piece depicted on the top section.

Turning now descriptively to the drawings, in which similar reference characters denote similar elements throughout the different views. The attached figures illustrate an "Emergency Air Supply Device" that is worn on the arm, preferably the wrist, and is also detachable, as it could be held and operated independently from and by the mouth. Additionally the air supply device can be worn as normal apparel, whether the strap is independent or part of apparel, such as a wet suit. The main components of this new invention include, an Arm/Wrist Strap 10 in the form of a wrist band Attached to the Wrist that houses within the strap all of the major operational components. This structure is what makes this device unique and novel, in that all other prior art is housed as an attachment to a strap, or is hand-held, or is umbilically connected to an air source and no such arm or wrist band device is available for an emergency air supply. This embodiment depicted in the drawings utilizes the element of the Arm/Wrist Strap 10 Attached to the Wrist or potentially detached and held in the mouth independent of the arm—as the structural device in and of itself, thus utilizing critical space necessary for adequate air supplies, in conjunction with creating a device that is nearly non-obtrusive or encumbering to wear on your arm during a normal routine day, whether engaged in a potentially air restrictive activity or not. Additionally the method of operation, is based on a unique air supply device that works both in or out of water and the design should be safe to use in all routine and normal daily activities.

This strap housing is fundamental in its design which does not attach air devices to it, but is the air supply device in and of itself. This design further supports a low profile, small footprint device that enables a new "ease of use" in order to encourage usage, that should be safe to use in all routine and normal daily activities, and does not unduly restrict your specific recreational or water sport activity, such as a belt or back based umbilical air supply system would in many water recreation or water sport activities. For instance if you were body surfing, the additional drag of a waist-belt air tank and umbilical tube, and the added safety risk of hitting a rock or sea bottom with them, would generally tend to not encourage its use.

Figure 2:
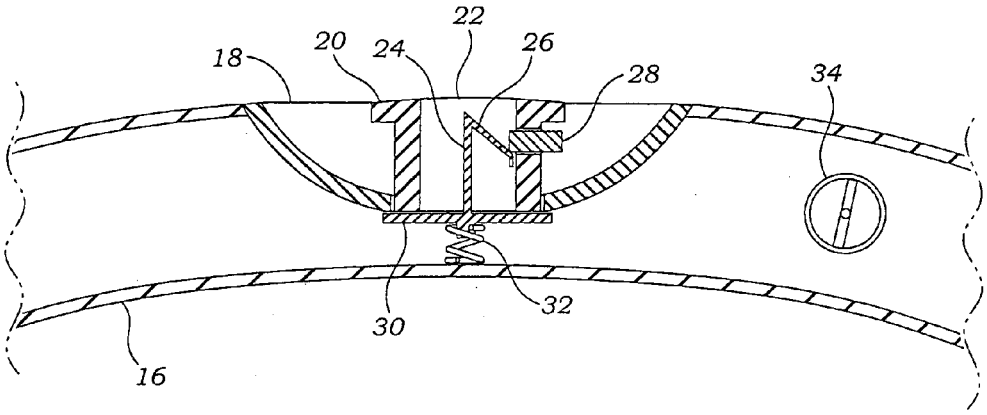
FIG. 2 Side view of the approximately half inch wide strap that would attach around the arm or wrist. Depicting the "single encasement air chamber", mouth piece air regulation system, and air valve for air reloading from a conventional air pump.
Figure 3:
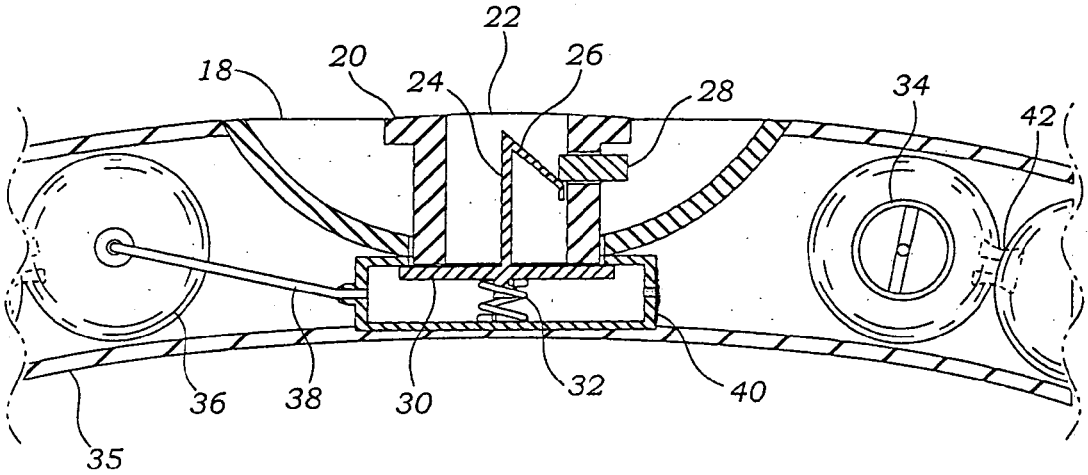
FIG. 3 Side view of the half inch wide strap that would attach around the arm or wrist. Depicting the "Multiple encasement air chamber" with air cylinders, mouth piece air regulation system, and air valve for air reloading from a conventional air pump.
Figure 4:
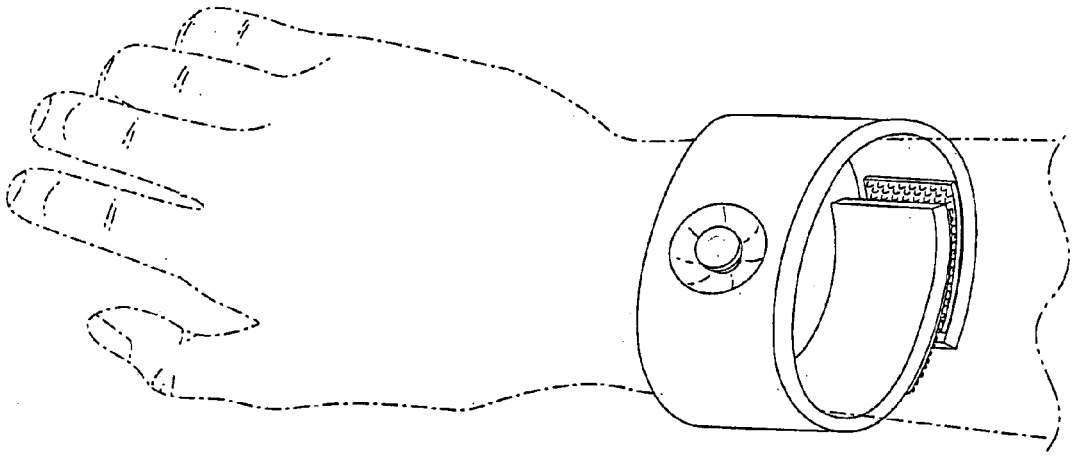
FIG. 4 is another overview of the devise having the user's hand broken away to display the fastening means (such as velcro, snaps, hooks, etc.). Here, velcro is used as the fastening means.
Figure 5:
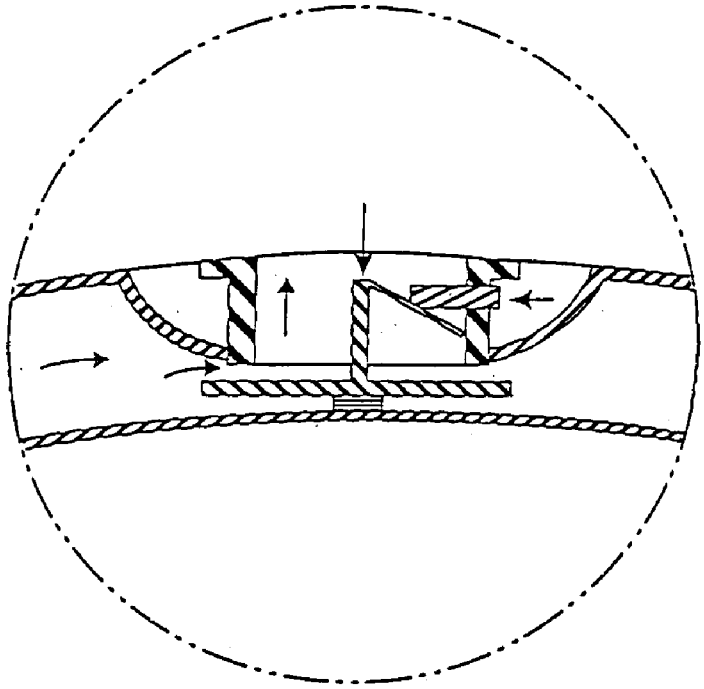
FIG. 5 is a side view of the devise showing a single encasement air chamber, a mouth piece, an on/off regulator button attached to the mouth piece, spring rod, valve stem, air seal, and an air seal spring. The figure shows that the on/off regulator button has been depressed, thereby creating pressure against the spring rod and pushing down the valve stem, which opens the air seal and then the air flows up through the hollow airway.
Figure 8:
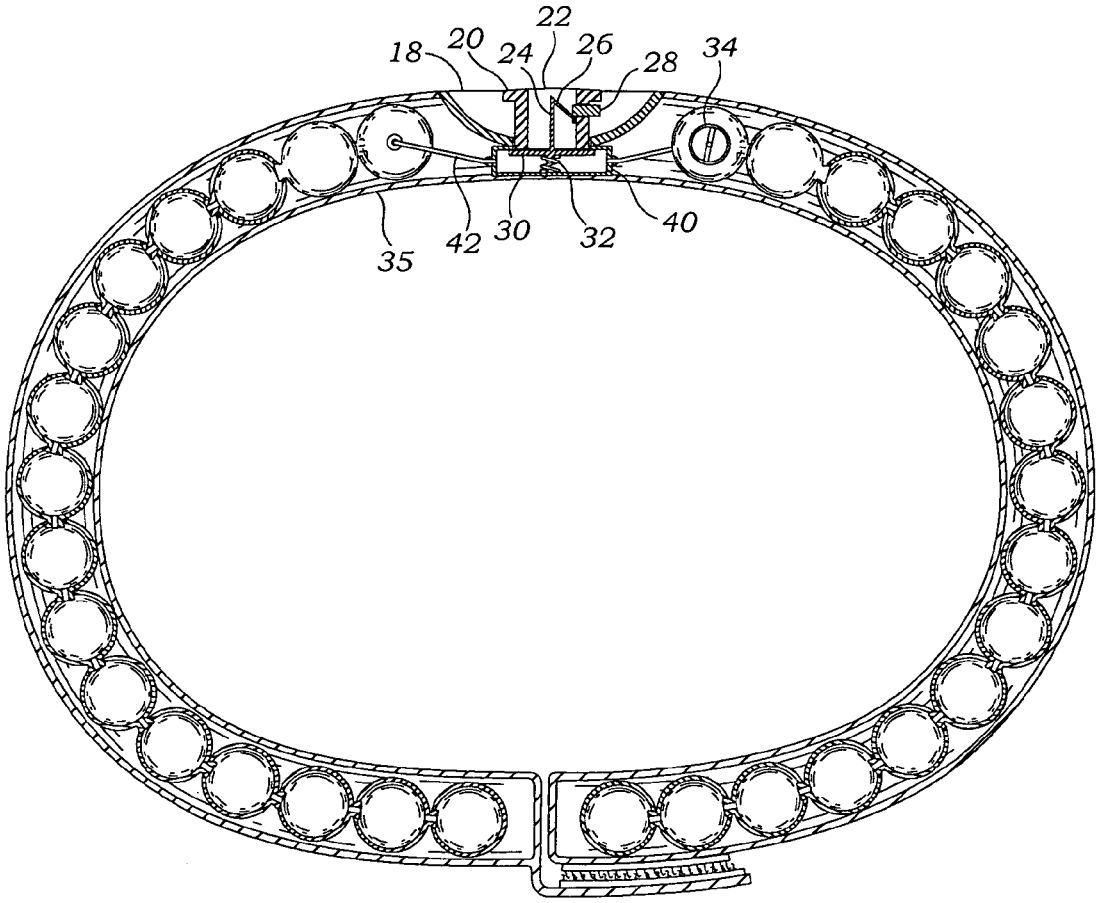
FIG. 8 is a broken away side view of the housing attach around the arm or wrist, depicting the "Multiple encasement air chamber" with air cylinders, mouth piece air regulation system, and air valve for air reloading from a conventional air pump.

There are 8 drawings (FIGS.: 1, 2, 3, 4, 5, 6, 7, and 8). FIGS. 1 and 4 is a general overview of the device attached to a wrist. FIGS. 2 and 3 depict two structurally different models. One model is seen in FIGS. 2 5, 6, 7 and 8 and it is called the "Singular Air Encasement Strap 16 which is the simplest design, which uses the wrist band strap to encase the air. FIGS. 3 and 8 depicts what is referred to as the "Multiple Air Cylinder Encasement Strap 35", which uses several cylinder tubes linked together that contain the pressurized air supply.

Figure 6:
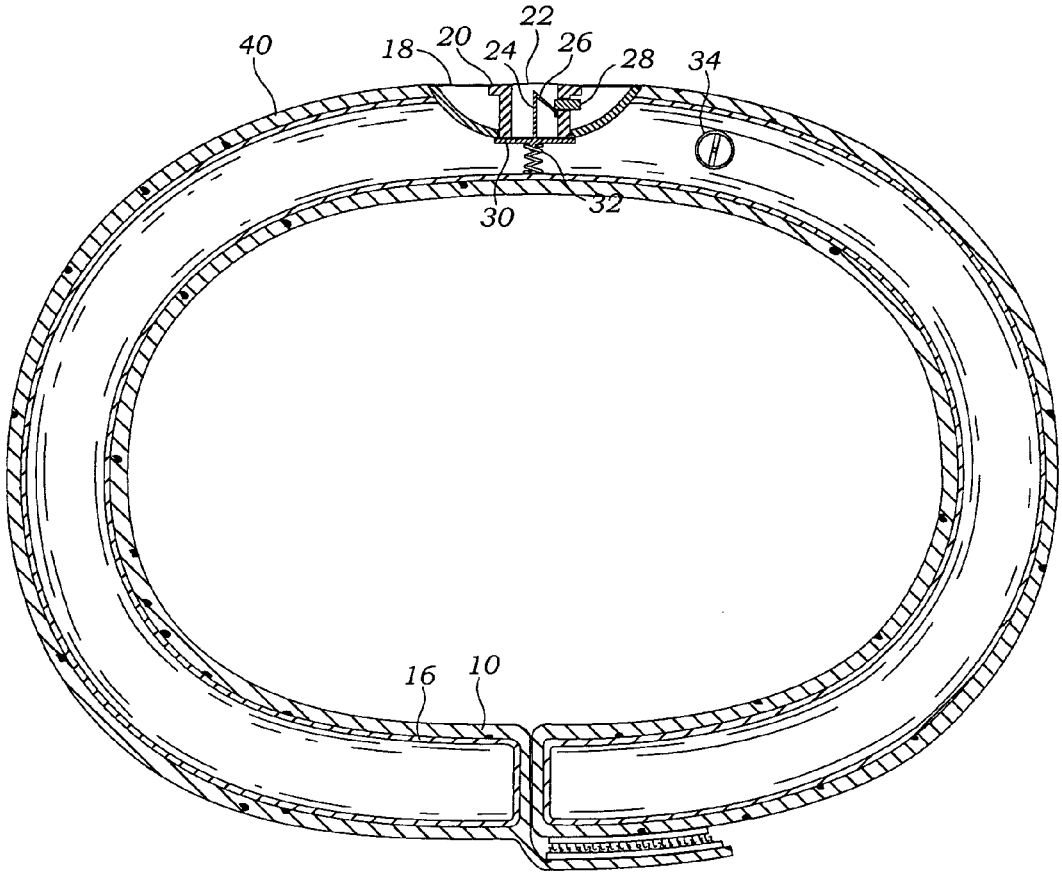
FIG. 6 is a broken away side view of the housing and the wrist band strap attach around the arm or wrist, depicting the "single encasement air chamber", mouth piece air regulation system, and air valve for air reloading from a conventional air pump.
Figure 7:
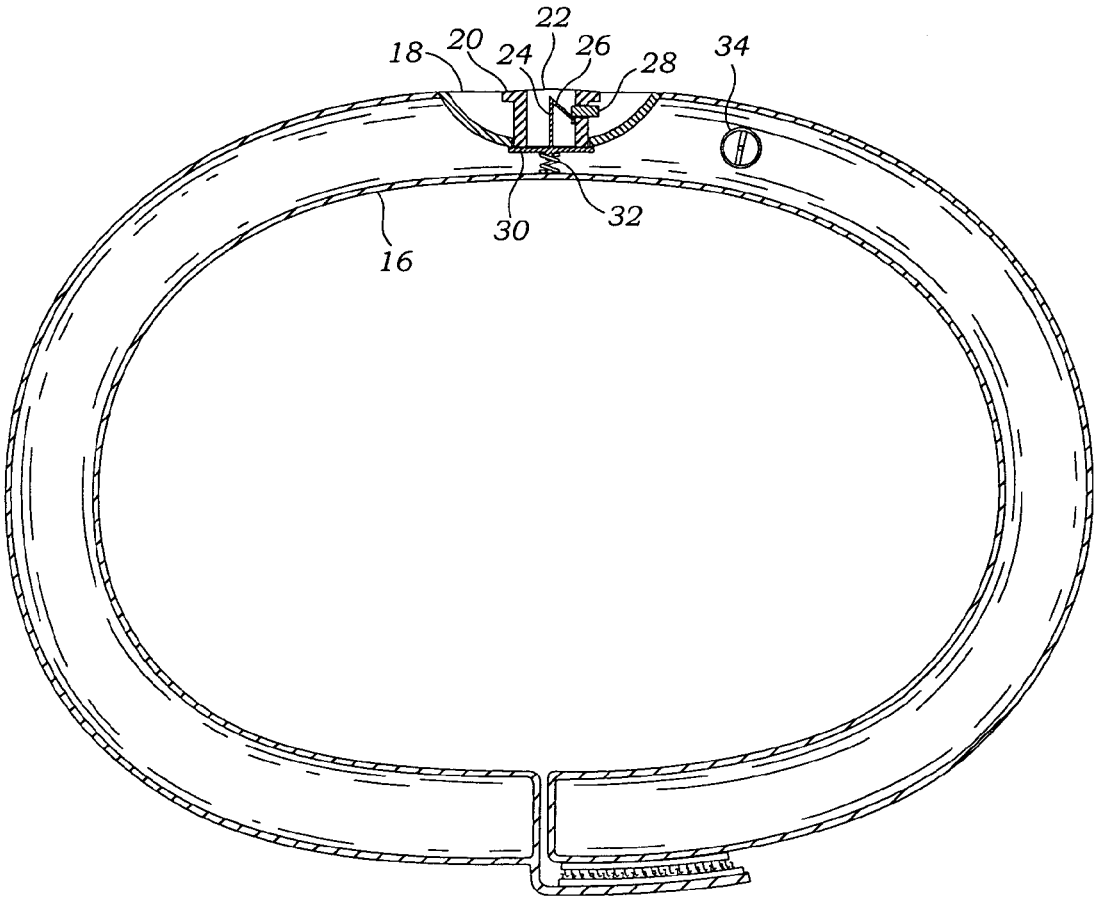
FIG. 7 is a broken away side view of the housing attach around the arm or wrist, depicting the "single encasement air chamber", mouth piece air regulation system, and air valve for air reloading from a conventional air pump.

In FIG. 6, an article of apparel 10 is shown in the form of a wrist band surrounding the housing having a single encasement air chamber, mouth piece air regulation system, and air valve for air reloading the air from a conventional air pump.

Any type of attachable strap that can be effectively released in a quick manner would be appropriate, such as (Velcro, Snaps, Hooks, and so on.) The length of the arm or wrist strap is dependent on the size of the arm and the desired amount of air supply. For the purposes of the drawings and textual explanations I will use a Velcro Strap attached to the wrist. The Velcro will be part of an appropriate material that is designed to dry quickly, such as nylon or rayon, generally a synthetic material, which will house either of the two model designs: 1) Singular Air Encasement Strap 16 or 2) a Multiple Air Cylinder Encasement Strap 35. However the Singular Air Encasement Strap 16 uses a dense rubber or rubber composite shell, that is appropriate to contain at least 200 psi (pounds per square inch), and therefore the rubber containment shell, should be sufficient and not require any additional material. Contrary to that would be the Multiple Air Cylinder Encasement Strap 35, which uses shells having metallic or non-metallic high pressure Air Cylinders 36, and should be capable of holding up to 1200 psi. The Air Cylinders 36 can be connected with a variety of means, dependent on the manufacturer. In the illustrated drawing FIG. (3)—I use the Cylinder Connection Links 42 made of metal with flanges on the ends that are sealed with rubber encased ends inside the Air Cylinders 36. The cylinders can vary in size, dependent on air requirements, but for an example, the Air Cylinders 36 would be approximately ½ inch in diameter and approximately 2 inches long, which should provide at 1200 psi approximately 10 liters of air or approximately 20 relaxed breaths. This would require a hand-pump that was hydraulic to refill. If you used the Singular Air Encasement Strap 16, with similar dimensions, you could easily hold up to 200 psi, at an estimated 2 liters or 4 relaxed breaths, using a standard hand-pump rated at 200 psi or greater to refill, using a conventional tire type Air Stem Valve 34, depicted in FIGS. 2 and 3, but labeled in FIG. 2. The tire type Air Stem Valve 34 for air input in FIG. 2 is connected to the side of the rubber encasement. The tire type Air Stem Valve 34 in FIG. 3 is attached through the side of the material sleeve of the wrist strap and connected directly into one of the Air Cylinders 36.

Note: These size and capacity measurements listed in the paragraph above and below are intended as a frame of reference and not intended to be absolutes, as technologies and manufacturing size and capacity requirements may change.

The Mouth Piece 20 shown in all of the drawings could be a variety of types, using a variety of methods, to operate such as shifting the mouth, pulling pushing or turning to open and close the flow of air. The design chosen in these illustrated examples is a low profile nearly mushroomed shaped design, which can be operated solely by the mouth to regulate air without the assistance of leverage from the arm, so that the device could be held and operated in the mouth if detached from the arm. This is accomplished by securing the mouth around the t-shaped or mushroom shaped Mouth Piece 20 top which is approximately ¾ inch round on top surrounded by a 2" diameter ⅜" Foam Shell 18 around the Mouth Piece 20. The foam is not necessary, it simply provides a flush connection between the Strap, and Mouth Piece 20, that is easily depressible with the mouth and teeth. Once the mouth is secure around the mouth piece 20—then simply bite with the teeth on the Mouth On/Off Air Regulator Button 28 and the air is released into the mouth. The amount of air exhausted from the device is largely dependent on the degree by which the user depresses on the Mouth On/Off Air Regulator Button 28. When the Mouth On/Off Air Regulator Button 28 in the open position (depressed with the teeth), the Spring Rod 26 or other type of leveraging guide, pushes down on the Valve Stem 24, which opens the Air Seal 30 and then the Air flows up through the (FIG. 1) hollow Air Way 22 into the mouth. As the teeth release the Mouth On/Off Air Regulator Button 28, the Air Seal Spring 32 closes the Air Seal 30. In FIG. 2 which depicts the Singular Air Encasement Strap 16, the air is routed through the Air Seal 30 up through the Hollow 22 Airway in the Mouth Piece 22 from the Hollow Singular Air Encasement Strap 16. In FIG. 3 which depicts the Multiple Air Cylinder Encasement Strap 35, the air flows from the Air Cylinders 36 through an appropriate high-pressure Air Hose 38, into the Air Release Chamber 40, and then up into the mouth, through the Hollow Airway in the Mouth Piece 22.

In operation this device is simply worn around the arm presumably the wrist and is intended for use in air restrictive conditions. Primarily it has been designed for the need to improve safety for water recreation or water sports were an individual is often caught gasping for air.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention.

Having thus described the invention, what is desired to be protected by Letters Patent is presented in the subsequently appended claims.

What is claimed is:

1. An air supply device comprising:

an article of apparel;

a housing for containing an air supply, wherein said housing is contained within said article of apparel and said air supply adapted to encircle a portion of an arm of a user;

a mouth piece, wherein one end of said mouth piece is fixedly attached to a means for containing said air supply within an article of apparel and the other end of said mouth piece is accessible to said user to inhale said air supply;

activating means for opening and closing said air supply comprising an on/off regulator attached to said mouth piece, a spring rod, a valve stem, an air seal, and an air seal spring;

wherein said user releases said air supply by pressing said user's mouth and teeth against said mouth piece and against said on/off regulator attached to said mouth piece; and wherein said device is self contained and adapted to be placed around said user's arm and does not utilize an external flexible hose conduit to transfer said air supply to said user.

2. An air supply device comprising:

an elongated wrist band strap having opposite ends, each of said ends having fastening means for securing said wrist band strap around a wrist of a user;

a housing for containing an air supply, wherein said housing is contained within said wrist band strap;

a mouth piece, wherein one end of said mouth piece is fixedly attached to said housing and the other end of said mouth piece is accessible to a user to inhale said air supply contained in said housing;

wherein said mouth piece is adapted to be positioned on a portion of said user's wrist and said housing containing said air supply is adapted to encircle the rest of said user's wrist;

where in said mouth piece comprises an on/off regulator button attached to said housing; a spring rod; a valve stem; an air seal; and an air seal spring; and wherein said device is self contained and adapted to be placed around said user's wrist and does not utilize an external flexible hose conduit to transfer said air supply to said user.

3. An air supply device comprising:

a wrist band strap having opposite ends, each of said ends having fastening means for securing said wrist band strap around a wrist of a user, wherein said wrist band strap has the size and profile equivalent to a wrist band;

means for containing an air supply within said wrist band strap;

said air supply contained within said wrist band strap is adapted to encircle said wrist of said user;

a mouth piece for opening and closing said air supply, wherein one end of said mouth piece is fixedly attached to said means for containing an air supply and the other end of said mouth piece is a stem accessible to said user to inhale said air supply contained within said wrist band strap; and wherein said air supply device is self contained and adapted to be placed around said user's wrist and does not utilize an external flexible hose conduit to transfer said air supply to said user.

4. An air supply device as in claim 3, wherein said means for containing said air supply comprises:

an air hose;

at least two air cylinders; and a cylinder connection link for connecting said air cylinders.

5. An air supply device as in claim 3, wherein said means for containing said air supply comprise:

a housing.

6. An air supply device as in claim 3, wherein said mouth piece comprises:

an on/off regulator button attached to said means for containing an air supply;

a spring rod;

a valve stem;

an air seal; and an air seal spring.

7. An air supply device as in claim 3, wherein said means for containing said air supply is chosen from the group consisting of a metallic high pressure shell, non-metallic high pressure shell, a single dense rubber shell, and a rubber composite based shell.

8. An air supply device comprising:

a wrist band strap having opposite ends, each of said ends having fastening means for securing said wrist band strap around a wrist of a user, wherein said wrist band strap has the size and profile equivalent to a wristband;

a housing for containing an air supply, wherein said housing is contained within said wrist band strap;

said air supply contained within said wrist band strap is adapted to encircle said wrist of said user;

a mouth piece, wherein one end of said mouth piece is fixedly attached to said housing and the other end of said mouth piece is accessible to a user to inhale said air supply contained in said housing;

activating means for opening and closing said air supply; and wherein said air supply device is self contained and adapted to be placed on a user's wrist and said air supply device does not utilize an external flexible hose conduit to transfer said air supply to said user.

9. An air supply device as in claim 8, wherein said actuating means for opening and closing said air supply comprises:

an on/off regulator button attached to said mouth piece;

a spring rod;

a valve stem;

an air seal;

an air seal spring; and wherein said user releases said air supply by pressing said on/off regulator button.

10. An air supply device as in claim 8, wherein said actuating means for opening and closing said air supply comprises:

an on/off regulator attached to said mouth piece;

a spring rod;

a valve stem;

an air seal;

an air seal spring; and wherein said user releases said air supply by pressing said user's mouth and teeth against said mouth piece and against said on/off regulator attached to said mouth piece.

11. An air supply device as in claim 8, where in said housing is comprised of:

a metallic high pressure shell.

12. An air supply device as in claim 8, where in said housing is comprised of:

a non-metallic high pressure shell.

13. An air supply device as in claim 8, wherein said housing is comprised of:

a single dense rubber shell.

14. An air supply device as in claim 8, wherein said housing is comprised of:

a rubber composite based shell.

15. A method of using an air encasement device comprising the steps:

providing an article of apparel; means for containing an air supply within said article of apparel comprises an air hose, at least two air cylinder, and a cylinder connection link for connecting said air cylinders; activating means for opening and closing said sir supply; a mouth piece, wherein one end of said mouth piece is fixedly attached to said means for containing said air supply and said other end of said mouth piece is a stem accessible to a user to inhale said air supply; said mouth piece is adapted to be positioned on a portion of a user's wrist and said means for containing said air supply encircles the rest of said user's wrist;

wherein said user's mouth is positioned around said mouth piece and said user triggers said activating means for opening said air supply thereby releasing the air into said mouth of said user;

wherein said user has taken the air into said user's mouth, said user triggers said activating means for closing said air supply; and wherein said device is self contained and adapted to be placed on said user's wrist and does not utilize an external flexible hose conduit to transfer said air supply to said user.

16. A method of using an air encasement device comprising the steps:

providing an article of apparel; means for containing an air supply within said article of apparel; activating means for opening and closing said air supply comprises an on/off regulator button attached to said mouth piece, a spring rod, a valve stem, an air seal, and an air seal spring; a mouth piece, wherein one end of said mouth piece is fixedly attached to said means for containing said air supply and said other end of said mouth piece is accessible to a user to inhale said air supply; said mouth piece is adapted to be positioned on a portion of said user's wrist and said means for containing said air supply is adapted to encircle the rest of said user's wrist;

wherein a mouth of said user is positioned around said mouth piece and user's mouth and teeth press against said mouth piece and against said on/off regulator button attached to said mouth piece, thereby releasing the air into said mouth of said user;

wherein said user has taken the air into said user's mouth, said user releases said user's mouth and teeth away from said mouth piece and away from said on/off regulator button, thereby closing said air supply; and wherein said device is self contained and adapted to be placed on said user's wrist and does not utilize an external flexible hose conduit to transfer said air supply to said user.

17. A refillable air supply device comprising:

an wrist band strap having opposite ends, each of said ends having fastening means for securing said wrist band strap around a wrist of a user, wherein said wrist band strap has the size and profile equivalent to a wristband;

means for containing an air supply within said wrist band strap;

said air supply contained within said wrist band strap is adapted to encircle said wrist of said user;

means for refilling said air supply within said wrist band strap;

a mouth piece, wherein one end of said mouth piece is attached to said means for containing an air supply and the other end of said mouth piece is accessible to said user to inhale said air supply contained in said wrist band strap;

activating means for opening and closing said air supply; and wherein said device is self contained and adapted to be placed on said user's wrist and does not utilize an external flexible hose conduit to transfer said air supply to said user.

18. A refillable air supply device as in claim 17, wherein said means for containing said air supply is chosen from the group consisting of a metallic high pressure shell, non-metallic high pressure shell, a single dense rubber shell, and a rubber composite based shell.

19. An air supply device comprising:

a housing for containing an air supply is adapted to be secured around the arm of a user;

a mouth piece, wherein one end of said mouth piece is fixedly attached to said housing for containing said air supply and the other end of said mouth piece is accessible to said user to inhale said air supply;

activating means for opening and closing said air supply;

wherein said mouth piece is adapted to be positioned on a portion of said user's wrist and said housing containing said air supply is adapted to encircle the rest of said user's wrist; and wherein said device is self contained and adapted to be placed on said user's wrist and does not utilize an external flexible hose conduit to transfer said air supply to said user.

20. An air supply device as in claim 19, wherein said housing for containing said air supply is chosen from the group consisting of a metallic high pressure shell, non-metallic high pressure shell, a single dense rubber shell, and a rubber composite based shell.

21. An air supply device as in claim 19, wherein said mouth piece comprises:

an on/off regulator button attached to said housing;

a spring rod;

a valve stem;

an air seal; and an air seal spring.

22. An air supply device as in claim 19, wherein said actuating means for opening and closing said air supply comprises:

an on/off regulator button attached to said mouth piece;

a spring rod;

a valve stem;

an air seal;

an air seal spring; and wherein said user releases said air supply by pressing said on/off regulator button.

23. An air supply device as in claim 19, wherein said actuating means for opening and closing said air supply comprises:

an on/off regulator attached to said mouth piece;

a spring rod;

a valve stem;

an air seal;

an air seal spring; and wherein said user releases said air supply by pressing said user's mouth and teeth against said mouth piece and against said on/off regulator attached to said mouth piece.

24. An air supply device comprising:

a housing;

means for containing an air supply within said a housing;

said means for containing said air supply is adapted to be secured around the arm of a user;

a mouth piece, wherein one end of said mouth piece is fixedly attached to said means for containing said air supply and the other end of said mouth piece is a stem accessible to a user to inhale said air supply;

activating means for opening and closing said air supply;

wherein said mouth piece is adapted to be positioned on a portion of said user's wrist and said means for containing said air supply is adapted to encircle the rest of said user's wrist; and wherein said device is self contained on said user's wrist and does not utilize an external flexible hose conduit to transfer said air supply to said user.

* * * * *